US010882664B2

(12) United States Patent
Nash

(10) Patent No.: US 10,882,664 B2
(45) Date of Patent: Jan. 5, 2021

(54) METHOD AND APPARATUS FOR COVERING A PORTION OF A PROPANE CYLINDER

(71) Applicant: Timothy S. Nash, Naples, FL (US)

(72) Inventor: Timothy S. Nash, Naples, FL (US)

( * ) Notice: Subject to any disclaimer, the term of this patent is extended or adjusted under 35 U.S.C. 154(b) by 0 days.

(21) Appl. No.: 15/002,484

(22) Filed: Jan. 21, 2016

(65) Prior Publication Data

US 2016/0325886 A1 Nov. 10, 2016

Related U.S. Application Data

(60) Provisional application No. 62/158,342, filed on May 7, 2015.

(51) Int. Cl.
*B65D 25/24* (2006.01)
*B65B 1/04* (2006.01)

(52) U.S. Cl.
CPC ..... *B65D 25/24* (2013.01)

(58) Field of Classification Search
CPC ..... B64F 5/0009; F17C 2203/01; F17C 2205/00; F17C 2205/018; F17C 2205/0394; F16M 13/00; B65D 25/24
USPC ..... 248/346.06; 426/523; 126/40; 294/152; 220/729
See application file for complete search history.

(56) References Cited

U.S. PATENT DOCUMENTS 1,303,153 A * 5/1919 Bennett ..... B65D 7/36 220/616
2,404,777 A * 7/1946 Gaines ..... A62C 13/003 220/320
2,997,199 A * 8/1961 Reachi ..... A24F 19/00 220/23.86
3,642,239 A * 2/1972 Zeiler, Jr. ..... E06C 7/14 211/71.01
3,963,226 A * 6/1976 Jankowski, Jr. ..... B65D 25/24 267/116
4,141,459 A * 2/1979 Eli, Jr. ..... B65D 25/24 138/96 R
4,880,130 A * 11/1989 Blake ..... B65D 25/20 220/655
5,584,345 A * 12/1996 Joy ..... A62C 13/78 169/30
6,634,827 B2 * 10/2003 Quinn ..... A01K 11/00 222/173
6,729,631 B2 * 5/2004 Trine ..... B62B 3/008 280/47.11
D560,047 S * 1/2008 Kershaw ..... D32/54
D579,514 S * 10/2008 Kelps ..... D23/206
(Continued)

*Primary Examiner* — Lawrence Averick

(74) *Attorney, Agent, or Firm* — Lyman Smith; Patent Service Assoc., Inc.

(57) ABSTRACT

A flexible, hardened material created for the added stability, rust prevention and safety for all users of propane cylinders, tanks, canisters or the like. The composition of device can vary in flexibility, hardness, color, composition, shape or size. The molding/forming of the device can include but is not limited to injection molding, rotational molding, blow molding, compression molding, transfer molding, silicone molding and vacuum thermoforming. The device can be formed from a composition which may include, but is not limited to, rubber, thermoplastics, polymers, and synthetics of various durometer. The device can be non-electrostatic and can protect against ambient ground electrostatic charges.

24 Claims, 5 Drawing Sheets

(56) References Cited

U.S. PATENT DOCUMENTS 7,520,549 B2 * 4/2009 Leighton ..... A45C 11/00 150/154
7,591,253 B2 * 9/2009 Martindale ..... F02D 19/081 123/27 GE
7,726,620 B1 * 6/2010 Kleespie ..... F17C 13/002 220/571
D665,871 S * 8/2012 Coupe ..... D23/206
D682,952 S * 5/2013 Vaslin ..... D15/199
D682,982 S * 5/2013 Wood ..... D23/206
D691,698 S * 10/2013 Frey ..... D23/206
8,839,983 B2 * 9/2014 Chiou ..... B65D 25/24 220/626
D733,380 S * 6/2015 Kessler ..... D23/206
9,528,659 B2 * 12/2016 Manser ..... F16M 11/04
2004/0016855 A1 * 1/2004 Berry ..... F17C 13/084 248/146
2005/0126501 A1 * 6/2005 Davis ..... A01K 5/0225 119/51.01
2007/0163568 A1 * 7/2007 Murray ..... A47J 37/0713 126/50
2011/0029262 A1 * 2/2011 Barkhouse ..... G01F 23/00 702/55
2011/0049167 A1 * 3/2011 Martin ..... B65D 23/001 220/630
2015/0035259 A1 * 2/2015 Umbro ..... B62B 1/12 280/654
2016/0201580 A1 * 7/2016 Ivers ..... F02D 19/0605 180/309

* cited by examiner

METHOD AND APPARATUS FOR COVERING A PORTION OF A PROPANE CYLINDER

CROSS REFERENCE TO RELATED APPLICATIONS

This application claims the benefit of priority of U.S. provisional patent application No. 62/158,342, filed May 7, 2015, the contents of which are herein incorporated by reference.

BACKGROUND OF THE INVENTION

The present invention relates to various methods and devices for adding stability, rust prevention, comfort and safety to the bottom of a propane cylinder, where the devices provide a non-static, non-electrical conductive ground contact. The device can fit on the base of the propane cylinder by covering the base of the cylinder partially or completely. A portion of the device can also fit on the top of a propane cylinder for better comfort and stability when transporting the cylinder.

Propane cylinders often tip over, leave rust on any material they sit on and can be dangerous to any person or object upon which the cylinder is in contact. Many propane cylinders, such as typical and frequently used barbeque propane cylinders, are also heavy and awkward to carry because of a thin piece of material that serves as a handle which is rigid, thin and has a small surface area to grab.

Propane tank sizes vary along with the materials they are made out of. All propane cylinders have a base they sit on that is made from similar materials as the tank. The base of the container often has a small diameter (making it unstable), blunt (making it dangerous) and when made out of various forms of metal, can rust. When the tank rusts, it can leave a rust stain on any material it contacts. The top of a propane tank usually has handles that are rigid and thin, making the tank awkward and uncomfortable to handle.

As can be seen, there is a need for an improvement that can be retrofitted to existing propane cylinders, or formed integrally with new propane cylinders, that overcomes the aforesaid mentioned issues with conventional propane cylinders.

SUMMARY OF THE INVENTION

The present invention provides composition and functionality for the addition of stability, comfort, rust prevention and safety for propane cylinders/tanks/canisters. The device can, for example, fit on the base of the propane cylinder by covering the base of the cylinder partially or completely.

An embodiment of the present invention provides a cover for a tank comprising a top portion for attachment to the tank, the top portion covering at least a portion of a bottom portion of the tank and preventing the bottom portion of the tank from contacting a surface upon which the tank rests.

Another embodiment of the present invention provides a method of stabilizing a tank on a surface comprising disposing a top portion of a cover on at least a portion of a bottom portion of the tank.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a flexible, hardened material created for the added stability, rust prevention and safety for all users of propane cylinders, tanks, canisters or the like. The composition of device, according to aspects of the present invention, can vary in flexibility, hardness, color, composition, shape or size. The molding/forming of the device can include but is not limited to injection molding, rotational molding, blow molding, compression molding, transfer molding, silicone molding and vacuum thermoforming. The device can be formed from a composition which may include, but is not limited to, rubber, thermoplastics, polymers, and synthetics of various durometer. The device can be non-electrostatic and can protect against ambient ground electrostatic charges.

As used herein, the terms, "Cylinder", "Propane", "Tank(s)", and "Canister(s)" are used interchangeably herein to refer to any container designed for gas or liquid storage. The term "Cover" is used to refer to any object that can completely or partially cover the base or top of a tank designed for the storage of gas, liquid, liquefied gas, or the like.

Figure 1:
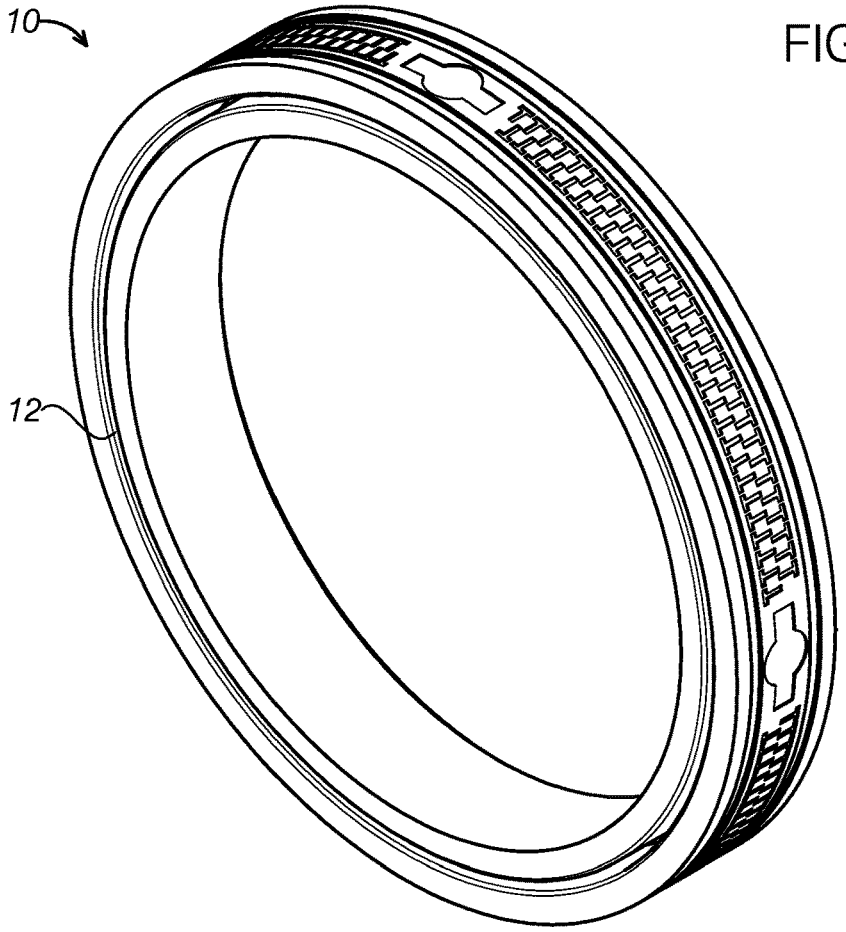
FIG. 1 is a perspective view of a propane tank cover according to an exemplary embodiment of the present invention.
Figure 1A:
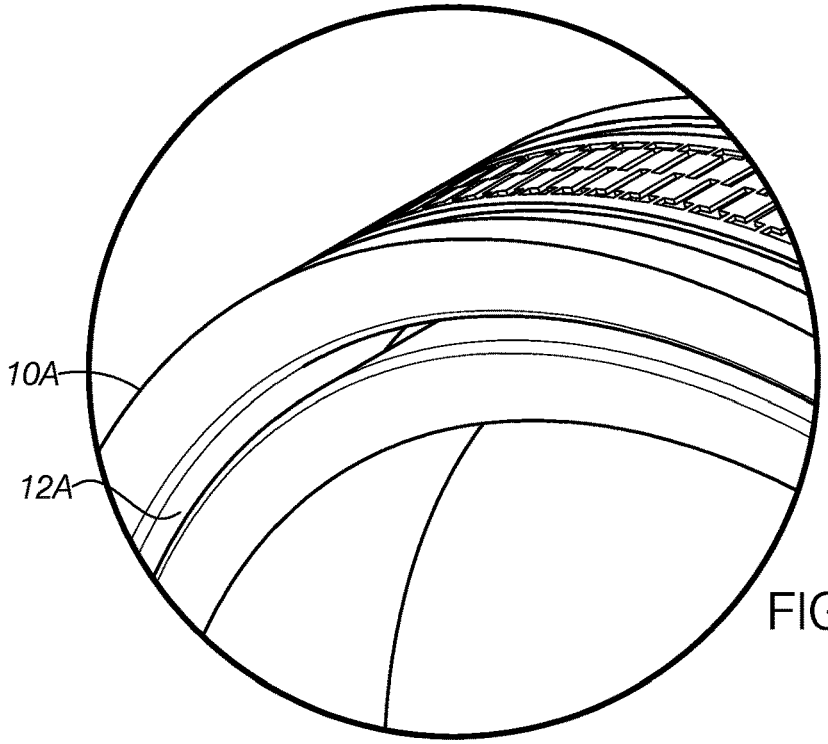
FIG. 1A is a perspective view of a multiple-piece propane tank cover according to an exemplary embodiment of the present invention.
Figure 2:
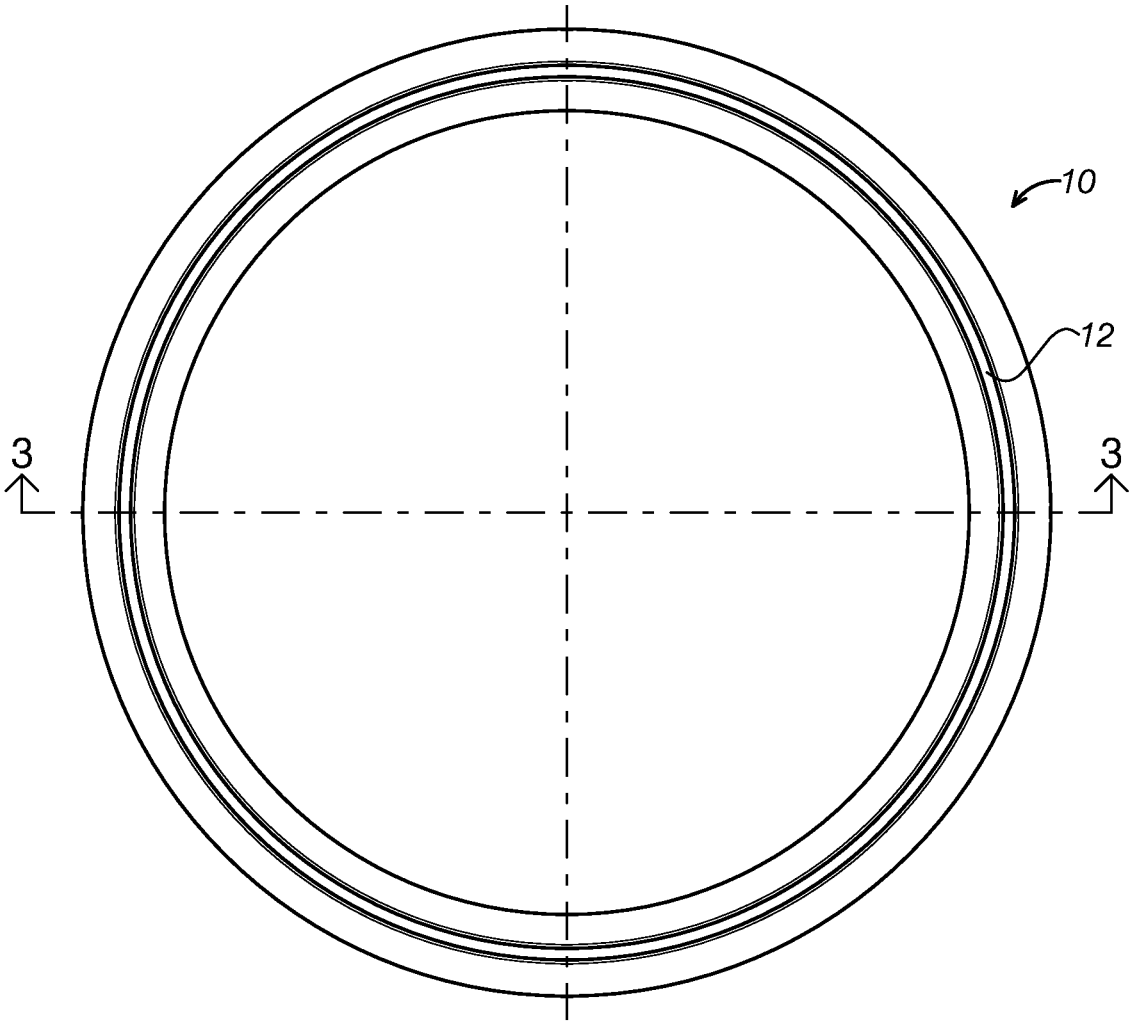
FIG. 2 is a top view of the propane tank cover of FIG. 1.
Figure 3:
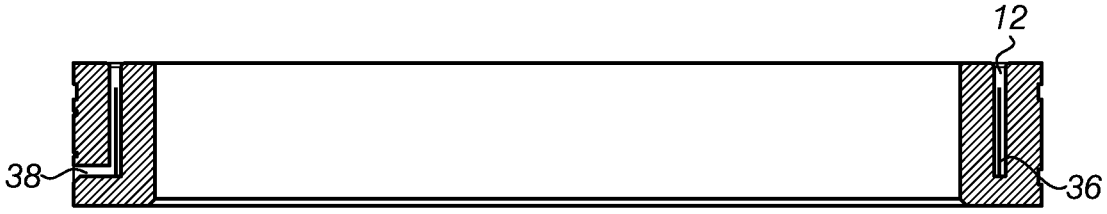
FIG. 3 is a cross-sectional side view taken along line A-A of the propane tank cover of FIG. 2.

Referring now to FIGS. 1-4, embodiments of the present invention provide a cover 10 that may fit about a base portion of a propane tank. The cover 10 may fit about the entirety of the base portion or may fit about a portion thereof. When fitting about the entirety of the base portion, the cover 10 may provide an alternate platform upon which the tank rests. In some embodiments, as shown in FIG. 1A, a multi-piece cover 10A may fit about a portion of the base of the propane tank. A slot 12A may be designed to receive the base portion of the propane tank therein. The multi-piece cover 10A may include at least three pieces for balancing the propane tank thereupon. When disposed in pieces, there may be sufficient flex therein to accommodate tanks with slightly different radii.

When fitting about a portion thereof, in some embodiments, the cover 10 may fit symmetrically about the base portion so that, when the tank rests on a surface, the tank may be stable and not angled. In some embodiments as shown in FIG. 1, the cover 10 may be provided as a single integral unit that fits upon the base portion of the tank. In other embodiments, as shown in FIG. 1A, the multi-piece cover 10A may be provided in multiple pieces adapted to be spaced apart or spaced together about the base portion.

Figure 4:
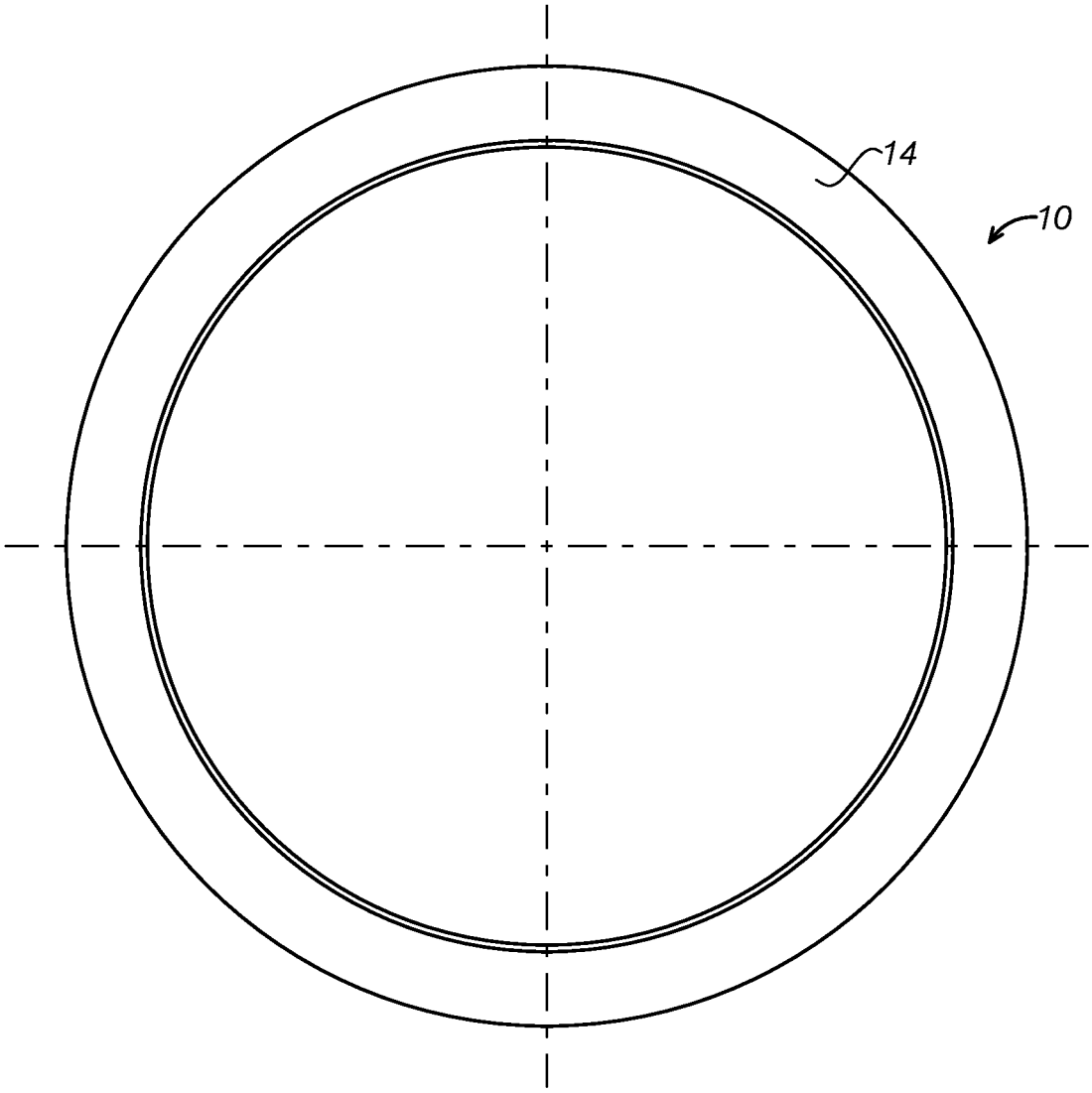
FIG. 4 is a bottom view of the propane tank cover of FIG. 1.

In some embodiments, the cover 10 may have a slit 12 cut into one side thereof. The slit 12 may be designed to receive a base portion of the propane tank. In some embodiments, the base portion of the propane tank can frictionally fit into the slit 12, thereby securing the cover 10 to the base portion of the propane tank. In some embodiments, the slit 12 may include ridges or other protrusions (not shown) to help provide a secure fit between the cover 10 and the propane tank. In some embodiments, one or more concentric slits 12 may be disposed on one side of the cover 10. This may be especially useful when slight variations may occur in the diameter of the base portion of a various propane tanks. In other embodiments, a slit of one diameter may be disposed in one side of the cover, while a slit of a different diameter may be disposed in an opposite side thereof, provided that one slit does not provide fluid communication with the other slit. In other words, as shown in FIG. 4, the slit 12 may not communicate to a bottom portion 14 of the cover 10.

Figure 6:
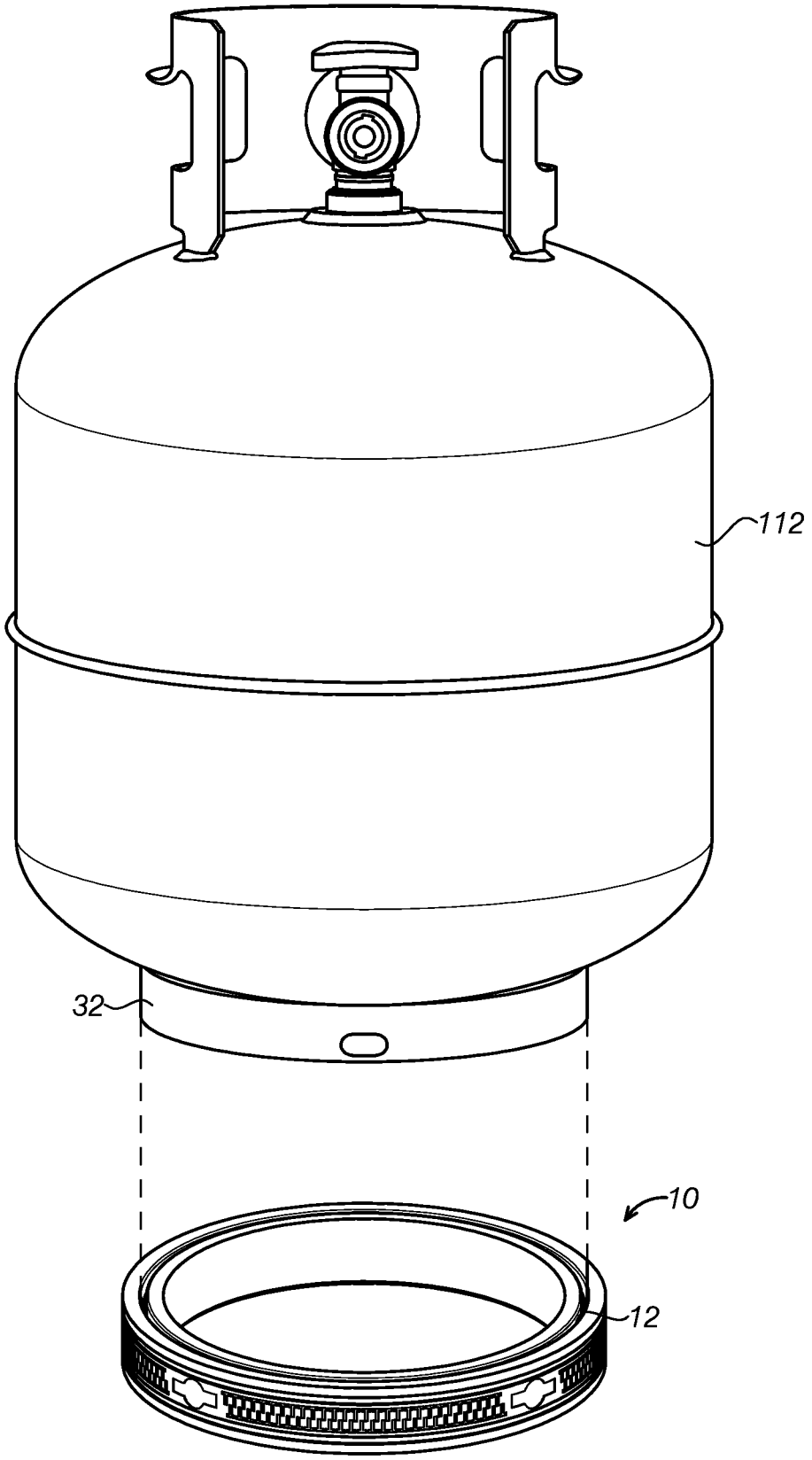
FIG. 6 is a perspective view showing the propane tank cover of FIG. 1 and a propane cylinder fitting thereinto.

The slit 12 may fit into the foot ring 32 of the propane tank 30 (see FIG. 6), however, in some embodiments, the slit 12 may be absent and the cover 10 may extend upward to attach to the tank itself. Regardless of method of attachment to the tank, the cover 10 may prevent direct contact between the tank and the surface upon which the tank is placed.

In some embodiments, the cover may fit on a top portion of the propane tank. While the Figures show specific sizes for the cover 10 and the slit 12, the dimensions of the cover of the present invention may vary to fit propane tanks of various sizes. The slit 12 typically extends from about 10% to about 90% of the depth of the cover 10. One or more vents 38 may be disposed to communicate an inside of the slit 12 to an exterior of the cover 10. The vents 38 may be disposed to communicate with an exterior side of the cover 10, as shown, or may be disposed to communicate with a bottom or inside portion of the cover 10.

The cover 10 may have a width from about ½ inch to about 4 inches, for example, where the width of the cover 10 may be the dimension facing the surface upon which the propane tank is placed. The width may provide a wider resting place for the tank, thus providing improved stability and increases surface area contact with the ground.

Figure 5:
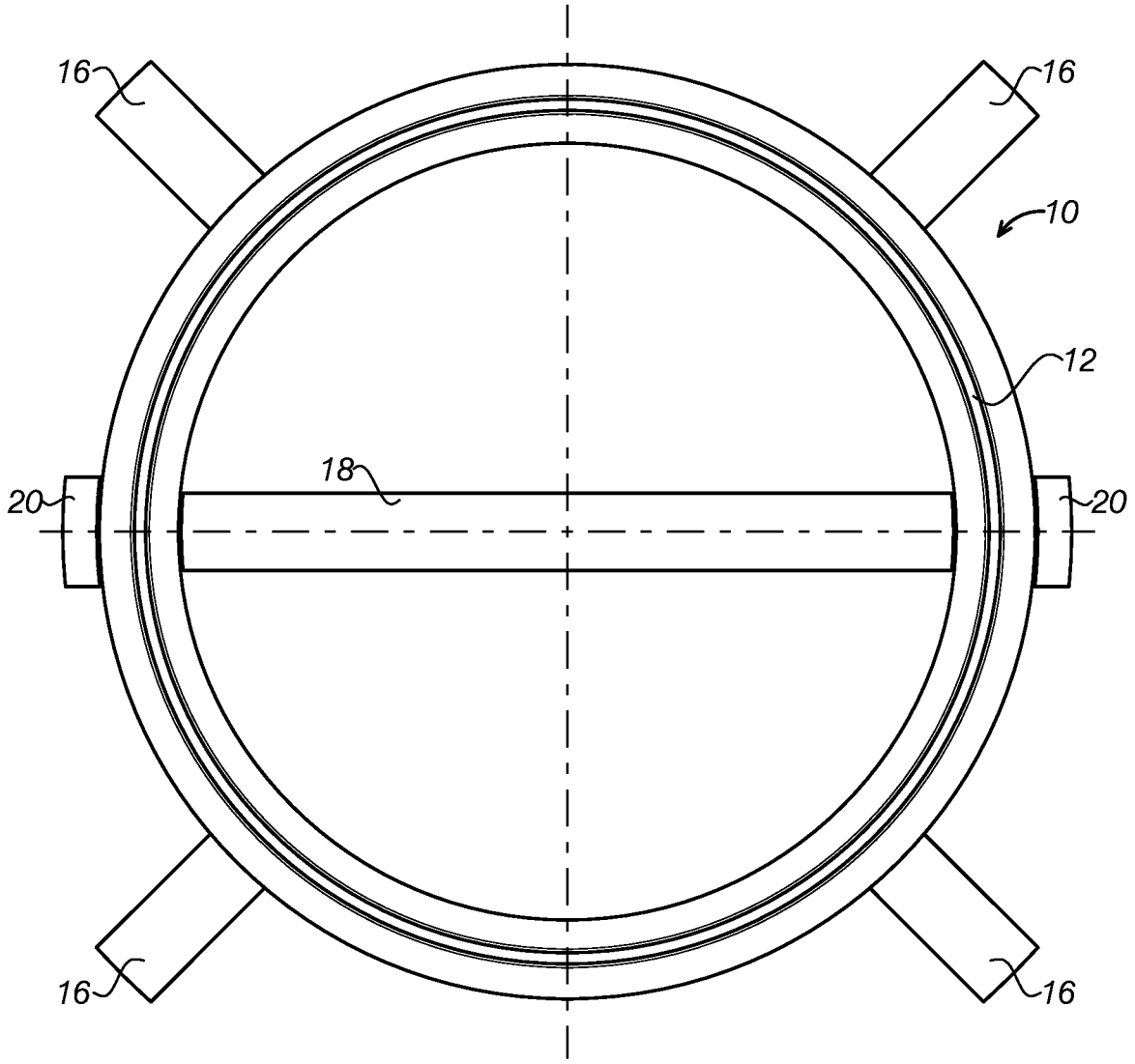
FIG. 5 is a top view of the propane tank cover of FIG. 1, including stabilization and securing accessories included therewith.

Referring to FIG. 5, various stabilization mechanisms may be included as integral components with the cover 10 or may be added onto the cover 10. In some embodiments, one or more external stabilizers 16 may be attached to an outside perimeter of the cover 10 and may be substantially planar with the bottom surface 14 of the cover 10. The external stabilizers 16 may attach to the cover 10 by various methods, such as friction fit, snap fit, bolt on, or the like.

One or more internal stabilizers 18 may be attached to an interior perimeter of the cover and may be substantially planar with the bottom surface 14 of the cover 10. The internal stabilizers 18 may attach to the cover 10 by various methods, such as friction fit, snap fit, bolt on, or the like. The internal stabilizers 18 may extend entirely across the inside of the cover 10, as shown in FIG. 5, or may extend only part way toward a center of the cover 10.

One or more, typically two or more strap loops 20 may be disposed on the cover. The strap loops 20 may allow a strap to pass therethrough to tie down the cover (and the propane tank inserted therein). The strap loops 20 may be useful, for example, in a bed of a pickup truck. The strap loops 20 may also be used to secure the propane tank to the cover 10 by passing a strap through the strap loops 20 and over the tank.

By removing the propane tank 30 from the ground (or other surface, such as a patio or the like), rusting of the base portion of the tank 30 may be minimized and, should rust form on the base portion 32 (also referred to as the foot ring 32), the rust is not transferred to the surface.

The cover may be formed in various shapes. While the Figures show a round cover, the cover may be formed in other shapes to match the base or top portions of the propane tank. The cover may also be formed of various materials. In one embodiment, the cover may be formed from a material having a hardness of 60A, for example. Regardless of material, in typical embodiments, the cover can be made from a non-electrostatic, non-electrical conductive ground contact. The cover may optionally include one or more grounding components. For example, one or more ground wires may be disposed to contact the tank disposed in the cover. The ground wire(s) may be used to contact a grounding surface, a metal grill, or the like. In some embodiments, a piece of metal 36 may be disposed in all or a portion of the slit 12 so that the foot ring 32 contacts the metal when the tank is disposed therein.

It should be understood, of course, that the foregoing relates to exemplary embodiments of the invention and that modifications may be made without departing from the spirit and scope of the invention as set forth in the following claims.

What is claimed is:

1. A cover for a tank comprising:

a top portion for attachment to the tank, the tank having a foot ring, the foot ring having an inside surface and an outside surface, the foot ring extending from a bottom portion of the tank and operable to support the tank on a surface, the cover preventing the foot ring of the tank from contacting the surface; and a slit in the top portion of the cover, the slit having an open top and first and second opposing concentric sides extending from the open top, the slit sandwiching at least a portion of the foot ring of the tank where the first side slit of the silt is disposed adjacent the inside surface and the second side of the slit is disposed adjacent the outside surface when the foot ring is disposed in the slit, wherein the top portion extending from an inside wall to an outside wall of the cover, the top portion defining at a planar upwardly facing top surface, the entirety of the upwardly facing top surface defining a first plane parallel with a second plane of a bottom surface of the cover.

2. The cover of claim 1, wherein the slit extends into the portion of the cover without extending through to a bottom portion of the cover.

3. The cover of claim 1, wherein the tank is a propane cylinder.

4. The cover of claim 1, wherein the cover is ring shaped.

5. The cover of claim 4, wherein the cover fits over an entire bottom portion of the tank.

6. The cover of claim 1, further comprising at least one external stabilizer extending from an outer perimeter of the cover.

7. The cover of claim 1, further comprising at least one internal stabilizer extending from an inner perimeter of the cover.

8. The cover of claim 1, further comprising at least one strap loop formed in the cover.

9. The cover of claim 1, further comprising at least one grounding component electrically configured to electrically connect to the tank when the tank is disposed in the cover.

10. The cover of claim 1, further comprising at least one ventilation hole communicating an interior of the slit with an exterior of the cover.

11. A method of using the cover of claim 1, comprising:

disposing the top portion of the cover on at least a portion of the foot ring of the propane tank; and receiving the foot ring of the propane tank in the slit formed in the top portion of the cover.

12. The method of claim 11, wherein the slit extends into the top portion of the cover without extending through to a bottom portion of the cover.

13. The method of claim 11, wherein the cover is ring shaped.

14. The method of claim 13, wherein the cover fits over an entire bottom portion of the tank.

15. The method of claim 11, further comprising stabilizing the tank with at least one external stabilizer extending from an outer perimeter of the cover.

16. The method of claim 11, further comprising stabilizing the tank with at least one internal stabilizer extending from an inner perimeter of the cover.

17. A cover for a base of a propane cylinder comprising:

a hoop base having an inner circular perimeter and an outer circular perimeter, the hoop base having a base surface and an upper surface opposite the base surface, the inner circular perimeter and the outer circular perimeter extending concentrically from the base surface to the upper surface;

an inner upstand extending upwardly from the upper surface of the hoop base defining an inner upstand inner wall and an inner upstand outer wall, and defining an inner thickness; and an outer upstand extending upwardly from the upper surface of the hoop base defining an outer upstand inner wall and an outer upstand outer wall, and defining an outer thickness, wherein the inner upstand and the outer upstand terminate to define a planar inner upwardly facing top surface and a planar outward upwardly facing top surface, wherein a first plane is defined by at least one of (1) an entirety of an inner upwardly facing top surface of the inner upstand, between the inner upstand inner wall and the inner upstand outer wall, and (2) an entirety of an outward upwardly facing top surface, between an outer upstand inner wall and an outer upstand outer wall is parallel to the base surface; and the outer upstand inner wall and the inner upstand outer wall face each other, are concentric and are spaced apart from each other so as to define a slot therebetween, with a base of the slot defined by the upper surface of the hoop base, the slot defining a minimum width and a depth.

18. The cover of claim 17, wherein the inner and outer upstands define cylindrical members that are concentric.

19. The cover of claim 17, wherein the inner upstand defines an inner height and the outer upstand defines an outer height, the inner height and the outer height being substantially equal.

20. The cover of claim 17, further comprising at least one opening extending through the hoop base and into the slot.

21. The cover of claim 17, wherein the inner wall of the outer upstand and the outer wall of the inner upstand has a uniform surface configuration, so as to be structurally configured to have the entirety of each of the inner wall of the outer upstand and the outer wall of the inner upstand abuttingly engage the base of the propane cylinder.

22. The cover of claim 17, wherein the inner thickness and the outer thickness are substantially equal.

23. The cover of claim 17, wherein the base surface of the ho base is planar, and wherein the slot is perpendicular thereto.

24. The cover of claim 17, wherein the cover is defined by an integrally molded flexible polymer member that is elastically deformable and structurally configured to be elastically deformable upon receipt of a base of a propane cylinder within the slot.

* * * * *